US005791119A

United States Patent [19]

Pienta

[11] Patent Number: 5,791,119

[45] Date of Patent: Aug. 11, 1998

[54] WRAPPING MACHINE

[75] Inventor: David J. Pienta, Lambertville, Mich.

[73] Assignee: Automatic Handling, Inc., Erie, Mich.

[21] Appl. No.: 920,105

[22] Filed: Aug. 26, 1997

[51] Int. Cl.[6] ..... B65B 11/04; B65B 41/16

[52] U.S. Cl. ..... 53/211; 53/587

[58] Field of Search ..... 53/211, 587, 214, 53/465, 409, 204, 136.2, 372.9

[56] References Cited

U.S. PATENT DOCUMENTS

| | | | |
|---|---|---|---|
| 3,716,964 | 2/1973 | Reynolds et al. | 53/211 X |
| 3,828,523 | 8/1974 | Brenner et al. | 53/211 X |
| 4,173,108 | 11/1979 | Eglinton et al. | 53/211 X |
| 4,362,001 | 12/1982 | Cockerham, Jr. et al. | 53/211 X |
| 4,534,151 | 8/1985 | Schneck et al. | 53/211 X |
| 4,736,567 | 4/1988 | Pienta . | |
| 4,882,892 | 11/1989 | Pienta . | |
| 5,086,610 | 2/1992 | Maki-Rahkola et al. | 53/587 |
| 5,546,729 | 8/1996 | Pienta | 53/211 |
| 5,628,167 | 5/1997 | Huson et al. | 53/211 X |

*Primary Examiner*—Horace M. Culver

*Attorney, Agent, or Firm*—Emch, Schaffer, Schaub & Porcello, Co., L.P.A.

[57] ABSTRACT

A wrapping machine for wrapping material layers on rolls is disclosed. A roll is delivered at ground elevation to the wrapping machine. A low lift assembly having pivotable arms and a push roller engages the roll and moves it upwardly to a motor driven drive roller. A carriage assembly, adjacent the drive roller, supports at least one supply roll of wrap material. The carriage assembly is movable along a path parallel to the drive roller and the roll being covered. The wrapping machine includes a guide assembly having a pair of arms movable between an initial rest position and a second position adjacent the ends of the roll.

12 Claims, 17 Drawing Sheets

29
26
28
50
51
86
52
53
39
33
34
48
55
45
30
32
49
39
33
87
40
29
25
28
82
81
83
85
84

WRAPPING MACHINE

Wrapping machines are well known in the art and are used to wrap various items. The wrapping machine, according to the present invention, is specifically designed to wrap a roll. While various types of rolls may be wrapped, the present machine is particularly useful in wrapping paper rolls or film rolls. Some paper rolls are very sensitive to marking. This type of roll may be wrapped with a protective foam layer. Often, the foam is then covered with an impervious plastic film outer layer.

In other situations, the rolled material must be protected against contamination. This type of roll is often wrapped with protective films or combinations of films.

The materials used to wrap the roll may include foam layers, bubble pack layers and various types of plastic films. Other wrapping material includes papers, such as Kraft paper. The wrapping machine, according to the present invention, is an improvement over wrapping machines which are shown in my previous U.S. Pat. Nos. 4,765,567 and 4,882,892.

SUMMARY OF THE INVENTION

The wrapping machine, according to the present invention, is suitable for wrapping a roll, for example wrapping a paper roll. A conveyor normally delivers the roll to be wrapped to the machine approximately at ground elevation.

The wrapping machine includes a low lift assembly having pivotable arms with lower ends. A push roller extends between the lower ends of the arms. A drive assembly includes a drive roller which is spaced from and parallel to said push roller. The drive assembly also includes a drive motor which is operatively connected to the drive roller. A carriage assembly of positioned adjacent the drive roller and supports at least one supply roll of wrap material. The carriage assembly is movable along a path parallel to the drive poller.

The wrapper machine also includes a guide assembly including a pair of arms which are vertically and horizontally movable between an initial rest position and a second position adjacent the ends of the roll. Each of the arms mounts a plurality of guide rollers which are positioned adjacent the ends of the roll.

DESCRIPTION OF THE PREFERRED EMBODIMENTS

Figure 1:
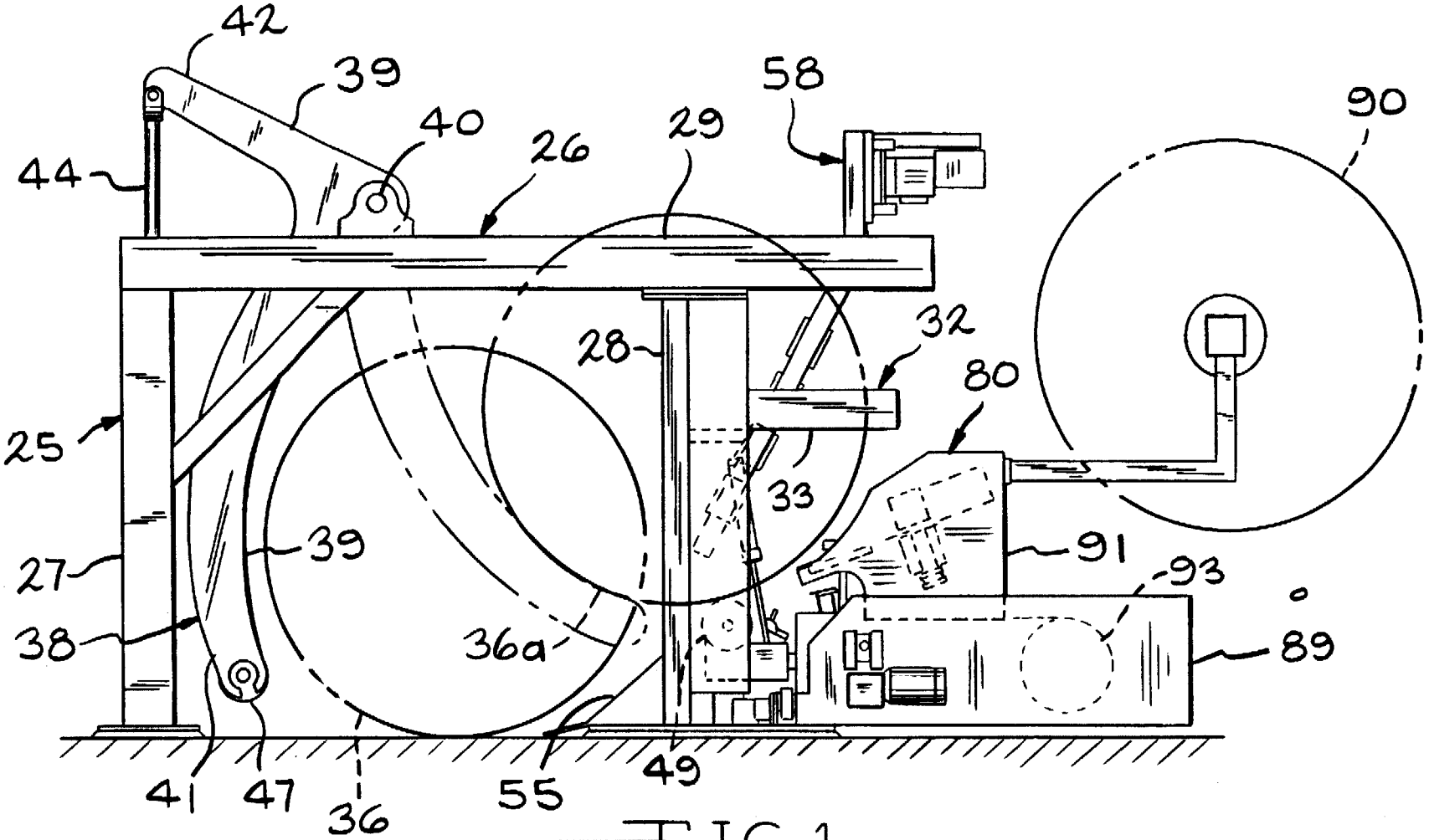
FIG. 1 is an elevational view of a wrapping machine, according to the present invention and showing by dashed lines the movement of a roll to be wrapped as it is placed in the machine.

A wrapping machine according to the present invention is generally indicated by the reference number 25. Referring to FIG. 1, the wrapping machine 25 includes a base frame 26 having front vertical legs 27, rear vertical legs 28, top frame members extending between respective ones of the vertical legs 27 and 28 and cross frame members 30 extending between the front vertical legs 27 and the rear vertical legs 28.

Figure 2:
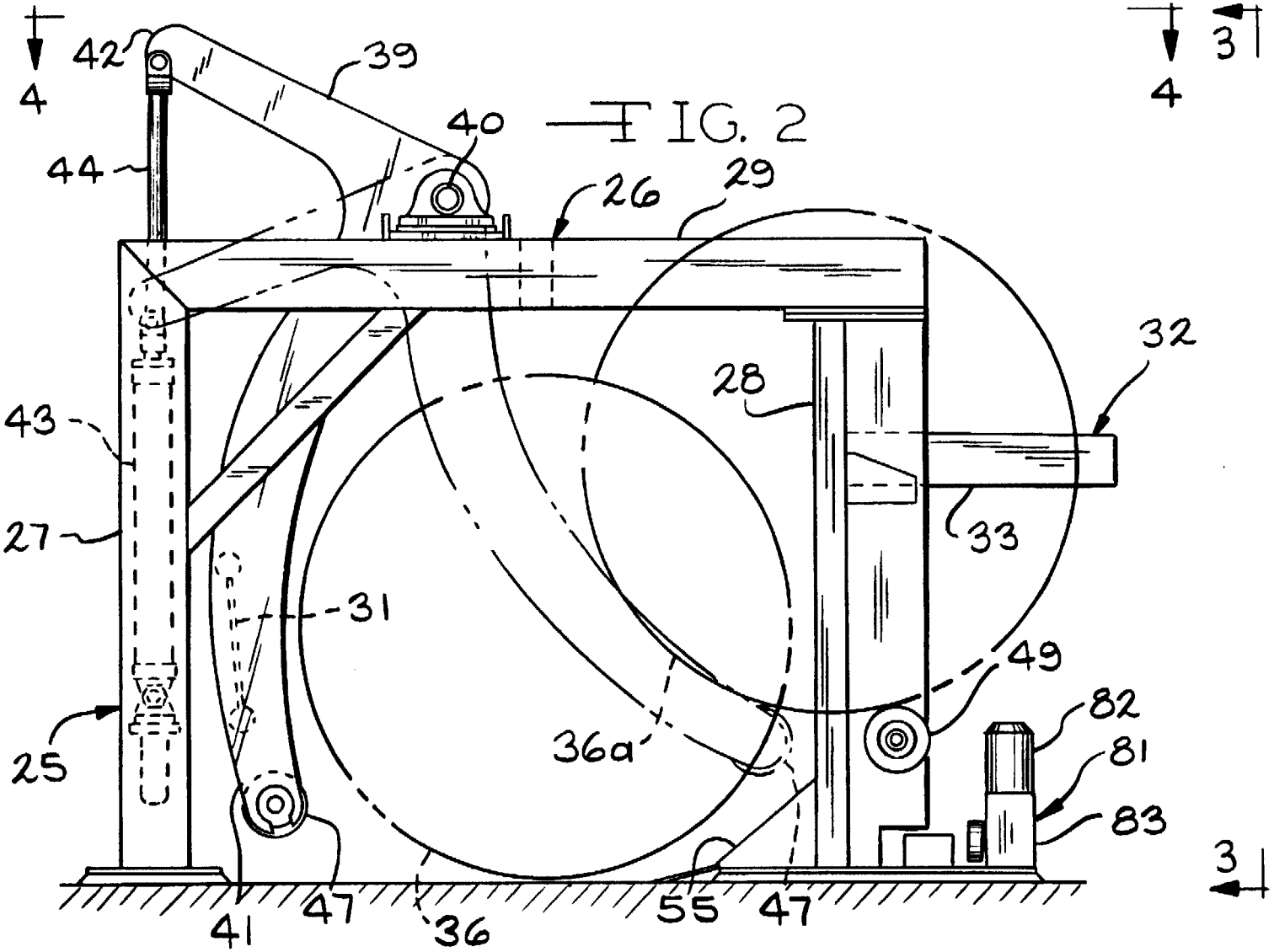
FIG. 2 is an enlarged elevetional view of a portion of the wrapping machine shown in FIG. 1.
Figure 3:
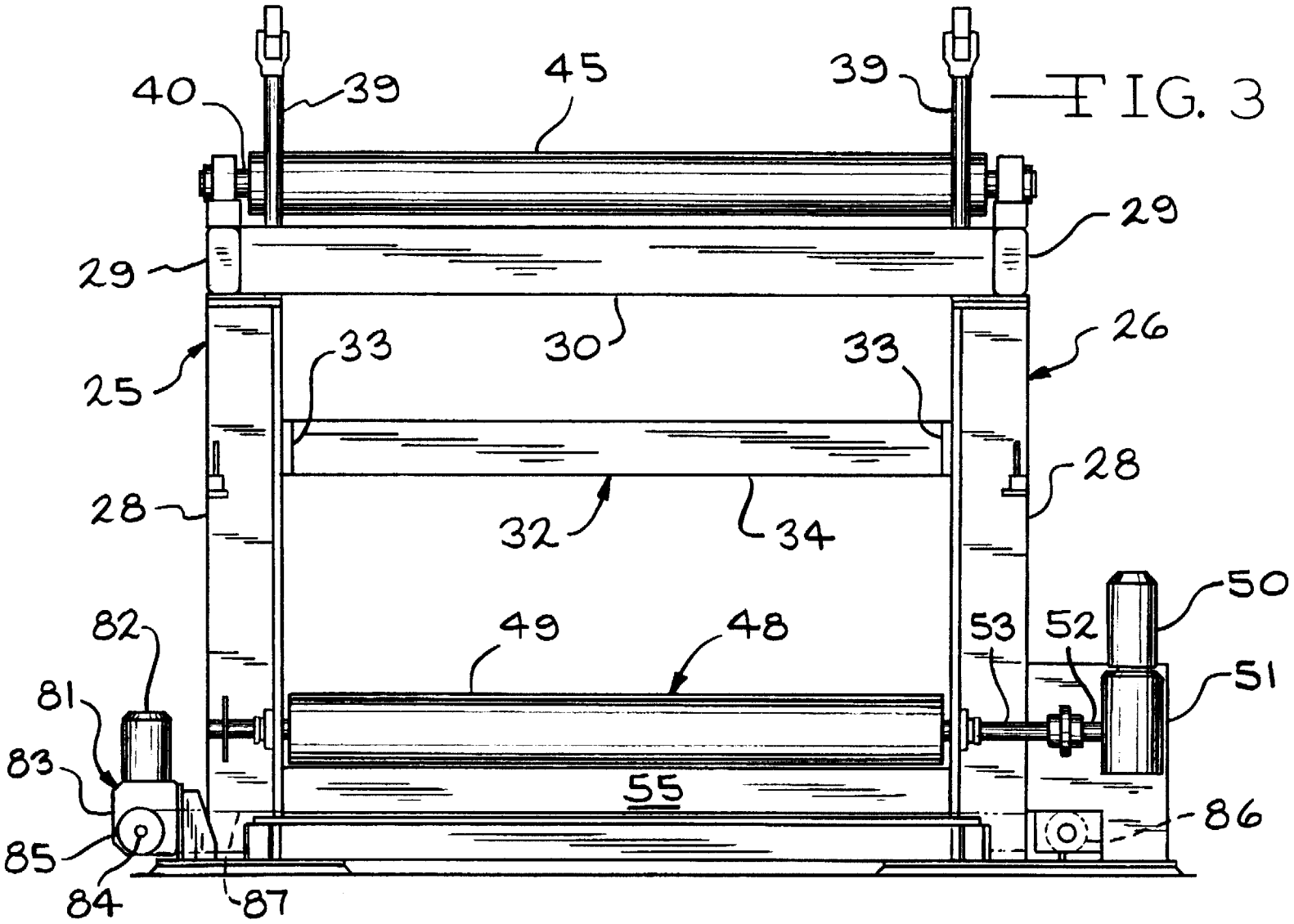
FIG. 3 is an end view taken along the line 3—3 of FIG. 2.

Referring to FIGS. 2 and 3, a roll frame assembly 32 is mounted between the rear vertical legs 28. The roll frame assembly 32 includes a pair of rearwardly extending arms 33 and a horizontal roll member 34 extending between the arms 33.

Referring to FIG. 1, a roll, for example a paper roll 36, is delivered by a conveyor to the wrapping machine 25 at approximately ground elevation. A low lift assembly 38 engages the paper roll 36 and moves it upwardly to the position indicated by the reference number **36*a*. The roll frame assembly 32 including the horizontal roll member 34 prevents the paper roll 36*a* from further rearward movement where it possibly would damage the wrapping machine 25** or injure an operator.

The low lift assembly 38 includes a pair of arms 39 which are pivotally mounted by a rod 40 which extends between the parallel top frame members 29. Each of the arms 39 includes a lower end 41 and an upper end 42. A cylinder 43 having a rod 44 is mounted adjacent the front vertical legs 27. The rod 44 is connected to the upper end 42 of the arm 39.

Referring to FIG. 3, a torque tube 45 surrounds the rod 40. The arms 39 are attached to the torque tube 45. The torque tube 45 insures that the arms 39 move in unison. A plate 46 extends between the spaced arms 39. The plate urges the arms 39 to work together and also acts as a guard against undesired forward movement of the roll 36. A push roller 47 is mounted for rotation between the lower ends 41 of the parallel pivotal arms 39. When the cylinder rod 44 is retracted, the push roller 47 engages the paper roll 36 and moves it upwardly to the position 36*a*, as indicated in FIG. 1.

Referring to FIG. 3, a drive assembly 48 includes a drive roller 49 which is journaled by and extends between the parallel rear vertical legs 38. The drive assembly 48 includes a drive motor 50 and a gear reduction box 51 having an output shaft 52. The output shaft 52 is operatively connected through a shaft 53 to the drive roller 49. When the roll 36 is moved to the position 36a, the roll is supported by the push roller 47 and the drive roller 49. When the motor 50 is activated, rotation of the drive roller 49 rotates the paper roll 36 during the wrapping process.

Figure 4:
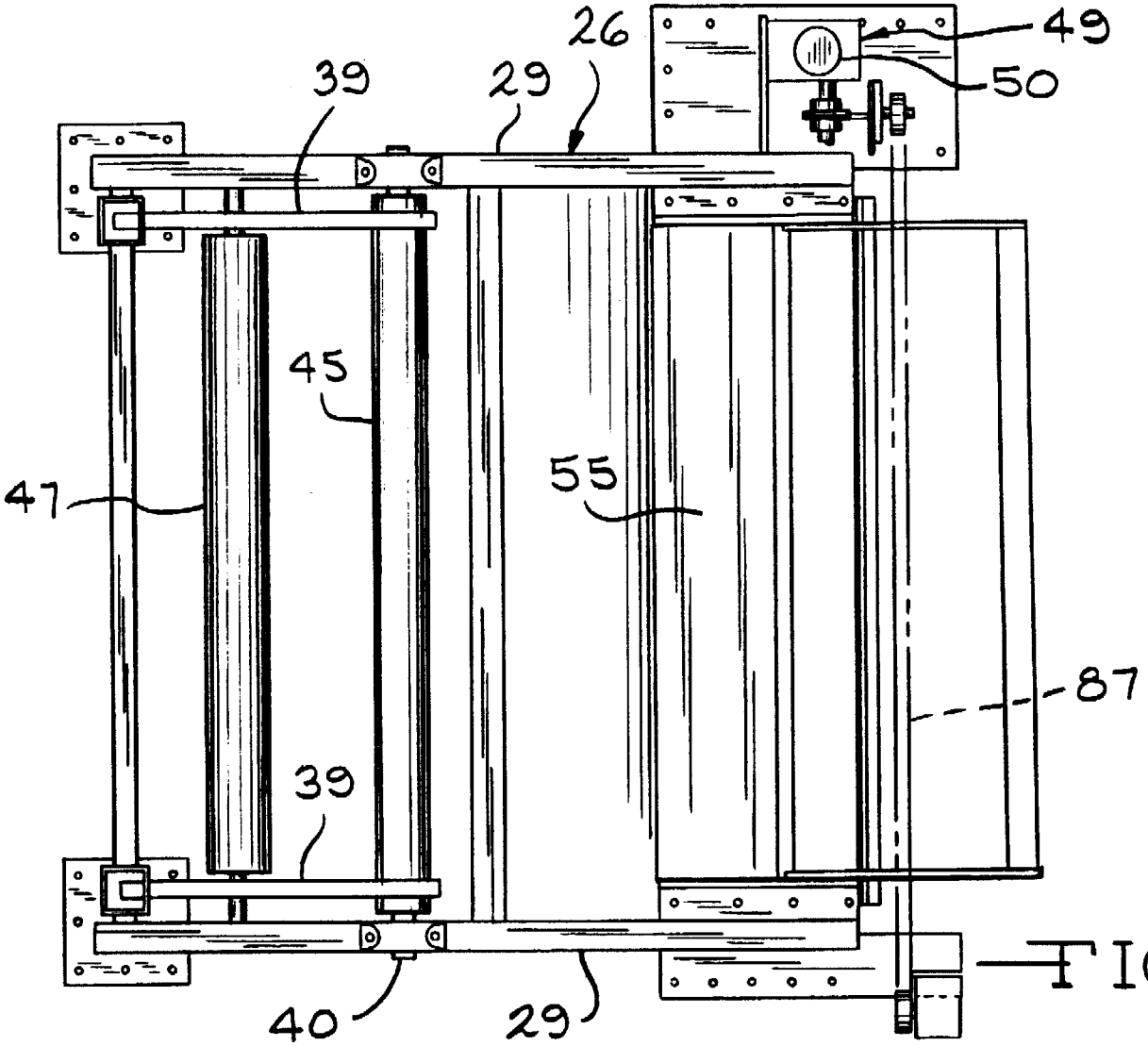
FIG. 4 is a top plan view taken along the line 4—4 of FIG. 2.

Referring to FIGS. 2 and 4, in the present embodiment a ramp member 55 extends between the lower portions of the rear vertical legs 28.

Figure 5:
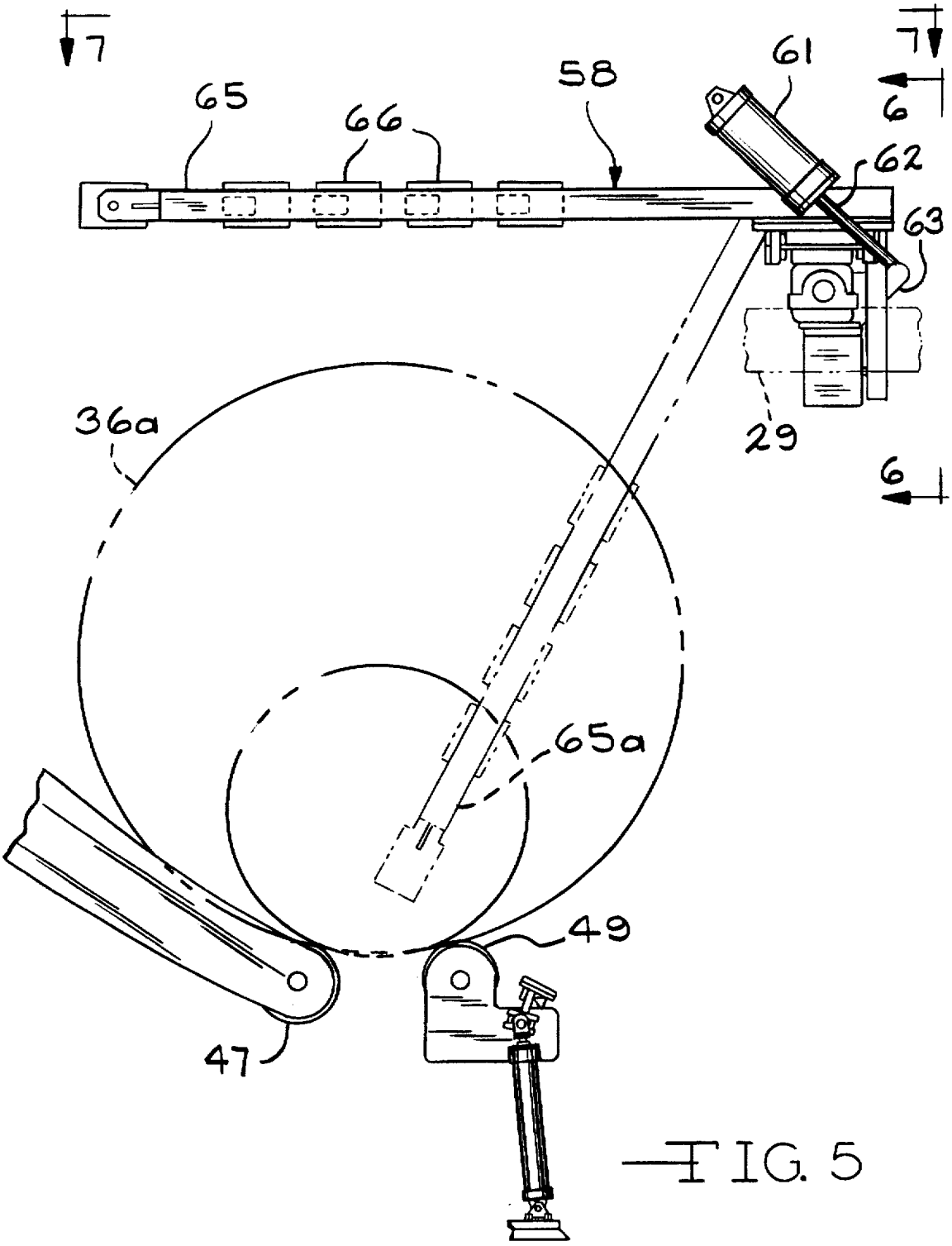
FIG. 5 is a fragmentary cross-sectional view showing the guide assembly of the wrapping machine and showing the guide arms in both an initial position and a second position adjacent the ends of a roll to be wrapped.
Figure 6:
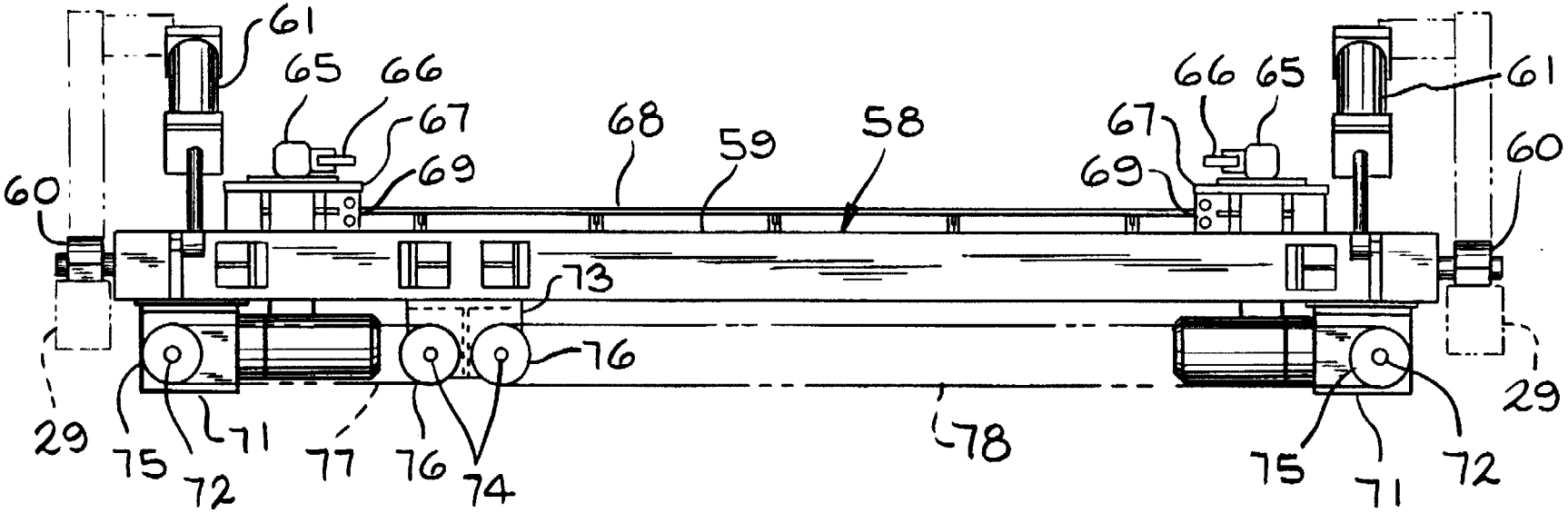
FIG. 6 is a fragmentary end view taken along the line 6—6 of FIG. 5.
Figure 7:
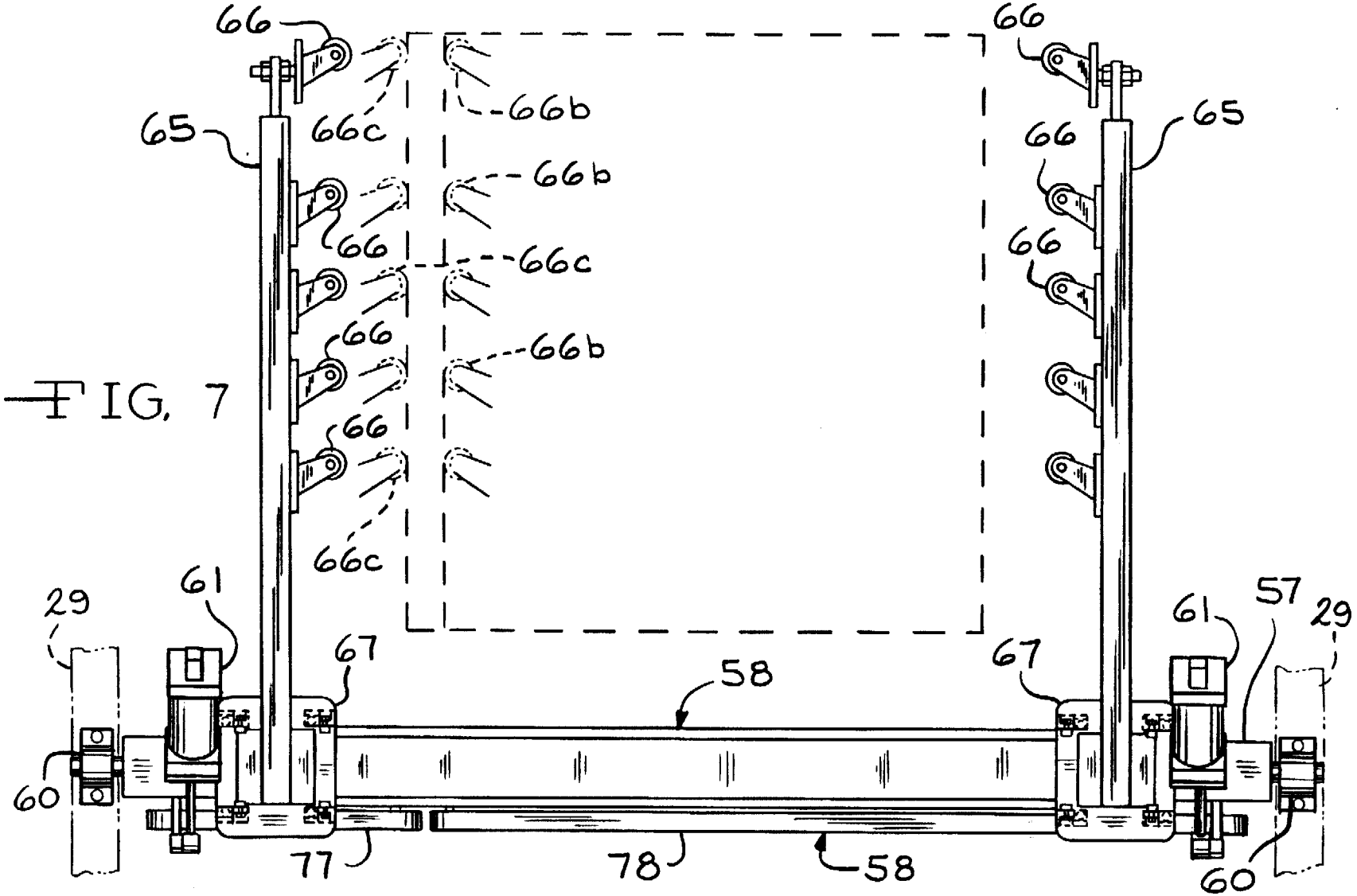
FIG. 7 is a fragmentary top view taken along the line 7—7 of FIG. 5; and showing by dashed lines the horizontal movement of the individual guide arms.

Referring to FIG. 1 and FIGS. 5, 6 and 7, a guide assembly 58 is mounted by and between the top frame members 29 adjacent the rear vertical legs 28. Referring to FIG. 6, the guide assembly 58 includes a longitudinally extending tube 59 which is mounted by a pair of pillow block assemblies 60 to the top frame members 29. The top frame members 29 also mount a pair of cylinders 61 having rods 62 connected to arms 63 which extend from the tube 59. Operation of the cylinder 61 rotates the tube 59 through a predetermined angle of rotation. In the present embodiment, the predetermined angle is 60°. Referring to FIGS. 5, 6 and 7, the guide assembly 58 includes a pair of arms 65 having a plurality of guide rollers 66 mounted thereon. Referring to FIG. 7, the arms 65 are mounted on travelling platforms 67. A plate 68 is spaced from and connected to the rotatable tube 59. Each of the travelling platforms include roller assemblies 69 which are mounted on the plate 68. The plate 68 acts as a guide track for the roller assemblies 69 and guides the movement of the platforms 67. A pair of motor and gearbox assemblies 71, having output shafts 72, are mounted on the tube 59 in opposed relationship to the travelling platforms 67. A pulley platform 73 having a pair of idler shafts 74 is mounted on the tube 59. Drive pulleys 75 are mounted on the output shafts 72 and idler pulleys 76 are mounted on the idler shafts 74. Belts 77 and 78 extend between the respective drive pulleys 75 and idler pulleys 76 and are operatively connected to the travelling platforms 67. Referring to FIG. 5, when the roll 36 is in the position 36*a*, it is initially supported by the push roller 47 and the drive roller 49. The guide assembly 58 is then activated and the guide arms 65 are pivoted downwardly from the solid line position shown in FIG. 5 to the dash line position 65a. This is accomplished by activating the cylinders 61 and rotating the tube 59. With the guide arms 65 in their correct positions indicated by the dash line position 65*a*, the guide arms 65 may be moved inwardly and outwardly to compensate for the lengths of the individual rolls 36.

Referring to FIG. 6 and 7, this is accomplished by activating the motor and gearbox assembly 71. Movement of the belt 78 and the attached guide arm 65 enables movement of the guide arm 65 through a number of positions. The most extreme position is indicated in FIG. 7 by the position of the guide rollers indicated by the reference number 66*b*. Similarly, when the belt 77 is activated, the second guide arm 65 may be moved to its most extreme position indicated by the guide roller position 66*c*. The flexibility of the guide assembly 58 insures a wrapping machine 25 having good stability and insures correct positioning of rolls 36 of various diameters and lengths.

Referring to FIG. 1, the wrapping machine 25 includes a carriage assembly 80 which traverses the width of the wrapping machine 25 as the wrapping material or materials is being dispensed. Referring to FIG. 3, the carriage assembly 80 includes a carriage drive assembly 81 including a motor 82, a gear reduction box 83 and an output shaft 84.

The output shaft 84 mounts a drive gear 85. An idler gear 86 is mounted on the opposite side of the base frame 26. The drive gear 85 and idler gear 86 mount a drive chain 87. The carriage assembly 80 includes a carriage 89 which is connected to the drive chain 87 and is moved transversely across the wrapping machine 25. The carriage 89 mounts a wrapping material roll 90. The wrapping material may be comprised of various materials, however in the present FIG. 1 embodiment the material is normally a foam material. In the FIG. 1 embodiment, the foam material from the roll 90 is moved through a feed assembly 91 and is directed to the periphery of the roll 36 being wrapped. One advantage of the wrapping machine 25 is that the roll 36 is initially received at the floor location and when moved upwardly to the position 36*a*, the lift is extremely low, normally being 24 inches or less.

In the FIG. 1 embodiment, a second wrapping material roll 93 is mounted by the carriage 89. Normally, the wrapping material of the roll 93 comprises a plastic film. While the foam material from the roll 90 and the plastic film material from the roll 93 may be interleaved, normally the foam material is applied first and the plastic film then wrapped as an outer impervious cover to form the final package.

Figure 8:
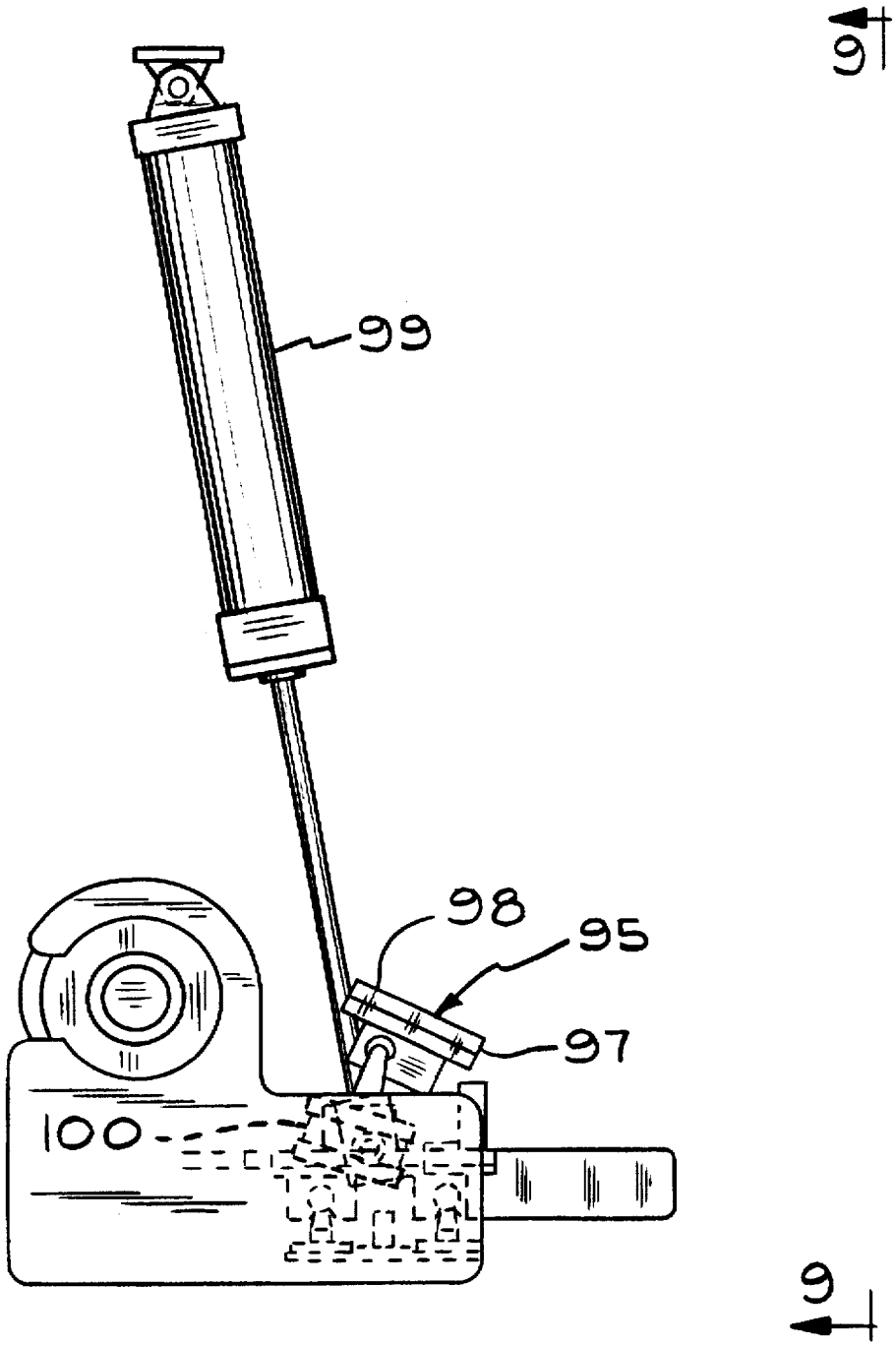
FIG. 8 is a fragmentary elevational view shown on an enlarged scale of a film applicator for attaching the end of the wrap material to the roll being wrapped.
Figure 9:
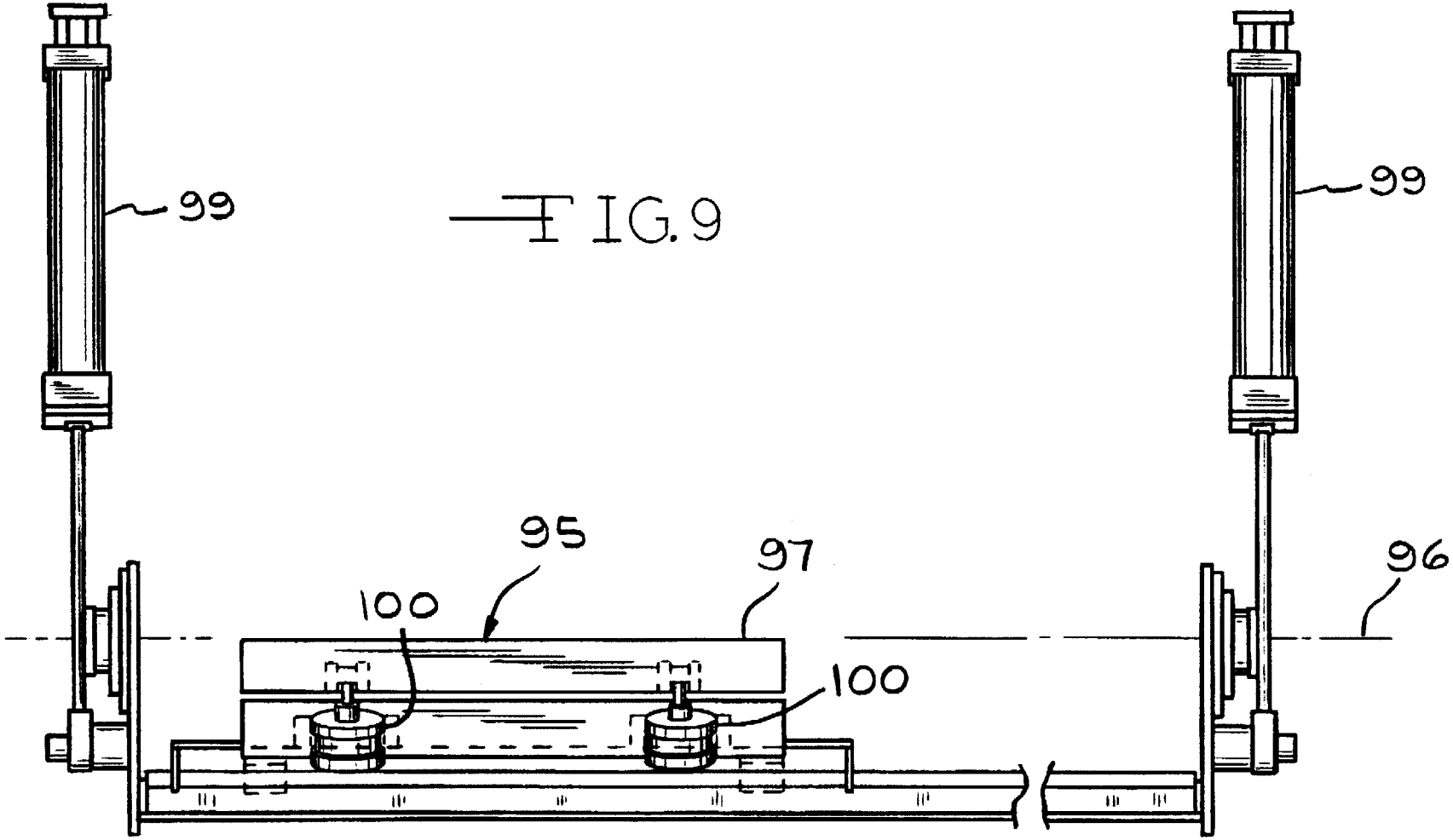
FIG. 9 is a fragmentary end view taken along the line 9—9 of FIG. 8.
Figure 10:
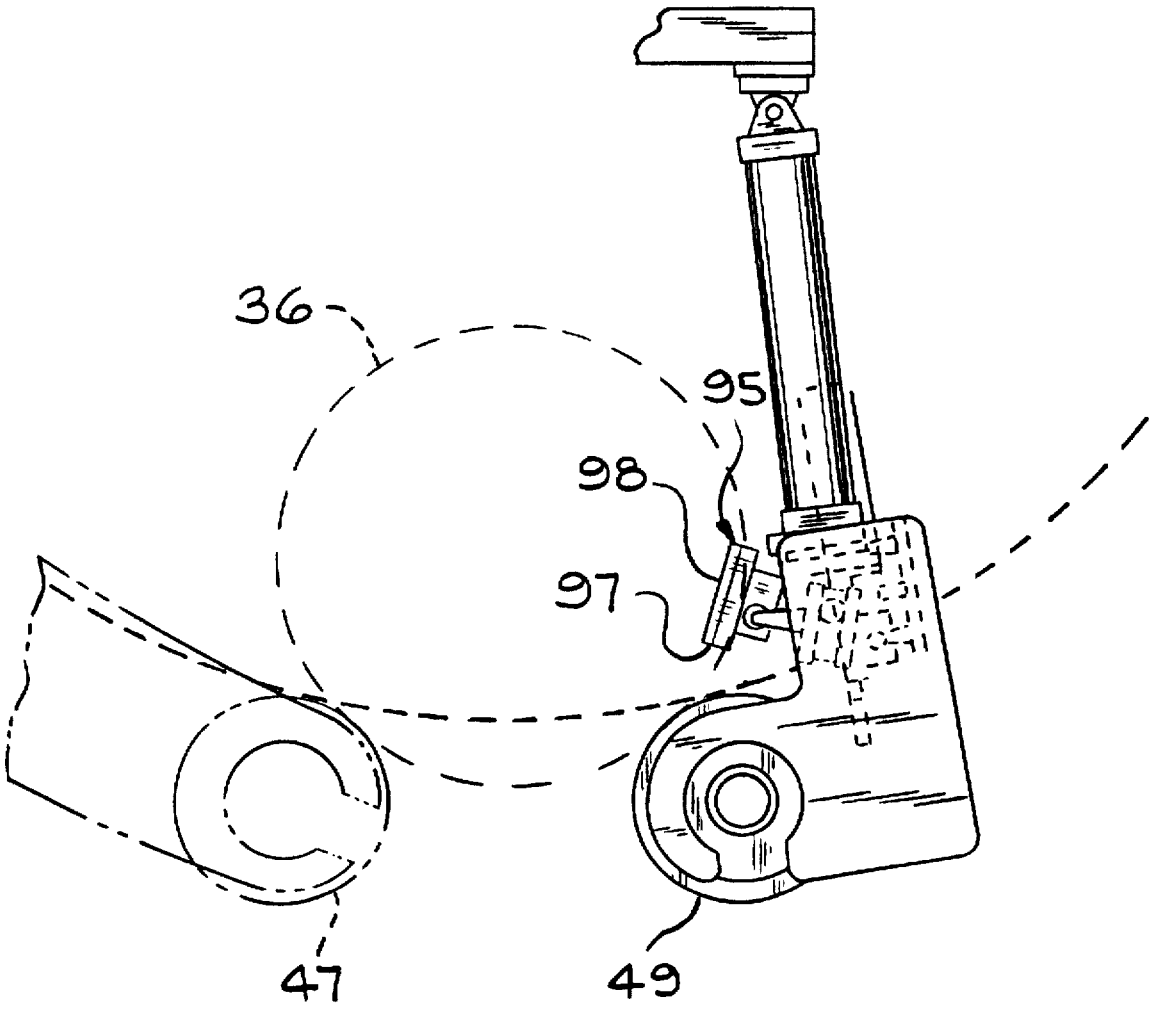
FIG. 10 is a view similar to FIG. 8, showing the film applicator after it has been rotated into position against the roll to be wrapped.

Preferably, the carriage assembly 80 includes a film applicator assembly 95 illustrated in FIGS. 8–10. Referring to FIG. 9, the film applicator assembly 95 pivots around an axis 96 aligned with the axis of the drive roller 49. The film applicator assembly 95 includes a vacuum head 97 having a vacuum surface 98. The plastic film from the roll 93, for example, is moved across the surface 98 of the vacuum head 97 and cylinders 99 rotate the film applicator assembly 95 from the FIG. 8 to the FIG. 10 position. A second pair of air cushion cylinders 100 rock the head 97 into position against the roll 36 to allow the wrapping material film to be attached to the roll 36 being wrapped.

Figures 11, 13:
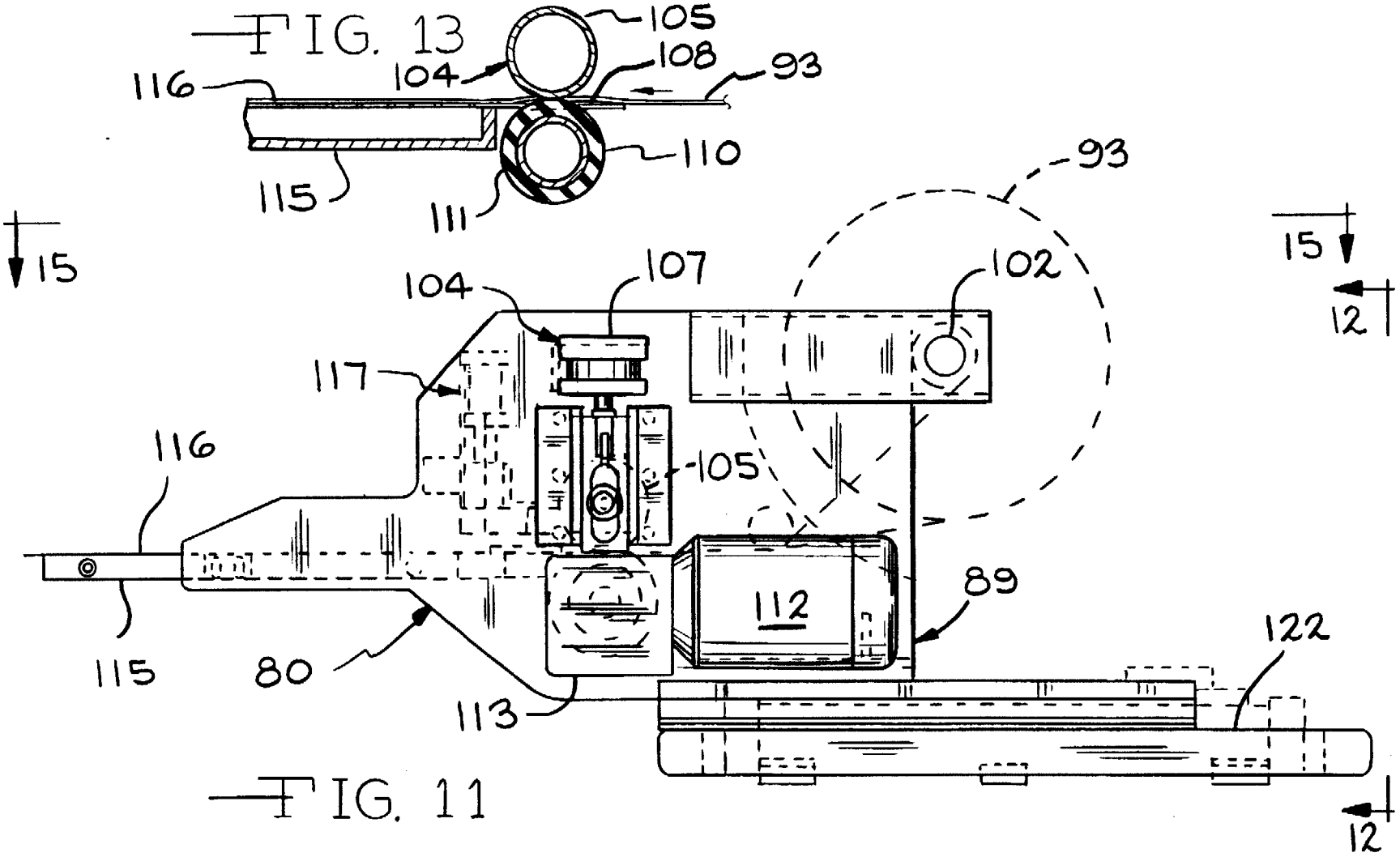
FIG. 11 is a fragmentary elevational view of a portion of the carriage assembly.
FIG. 13 is an enlarged, fragmentary cross-sectional view taken along the line 13—13 of FIG. 12.
Figure 15:
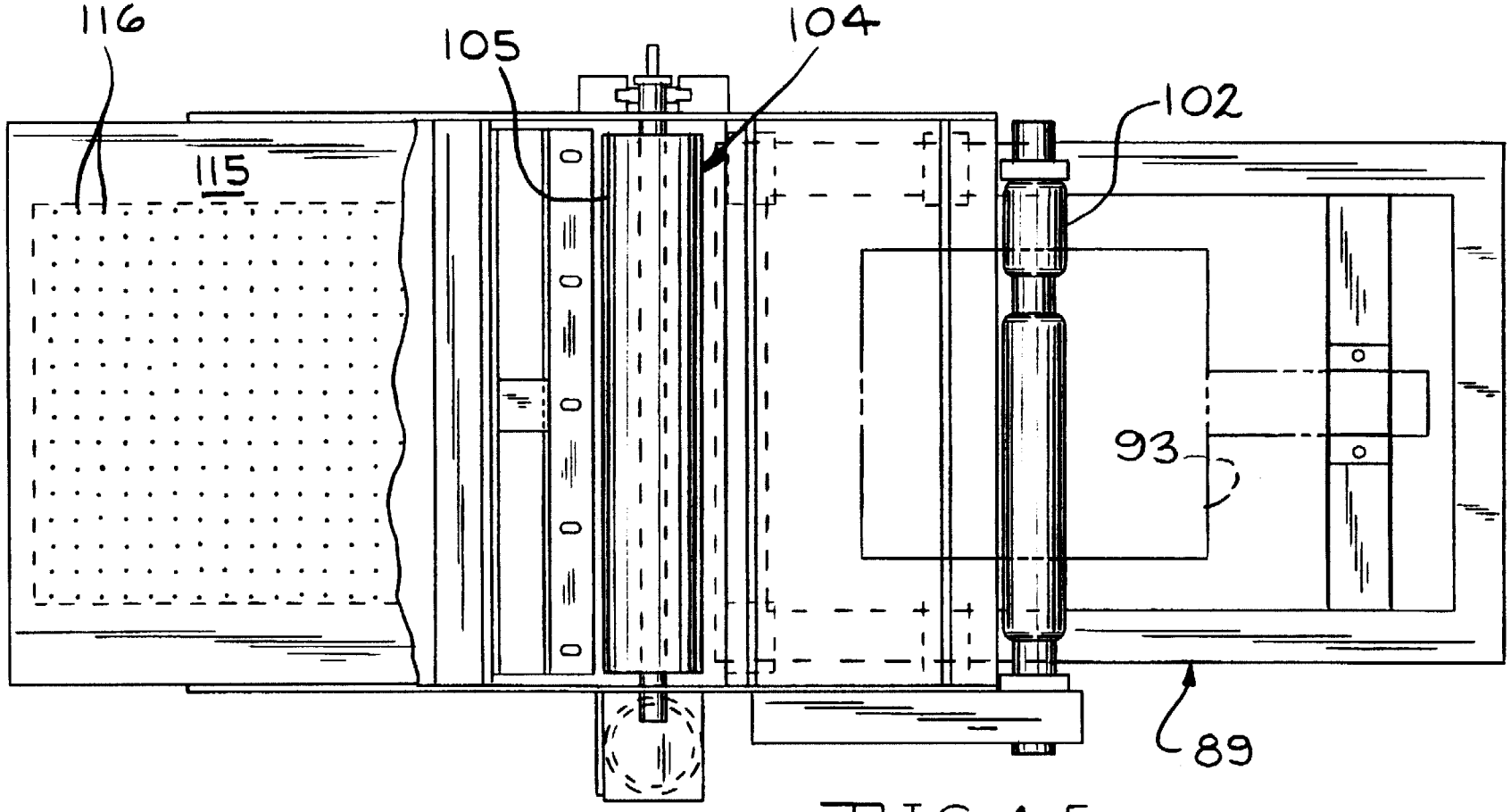
FIG. 15 is a top plan view of the carriage assembly.

Referring to FIGS. 11 and 15, the carriage 89 includes a shaft 102 for rotatably mounting the wrapping material roll 93. As the plastic film is moved from the roll 93 toward the wrap position, it passes over a roller assembly 104. The roller assembly 104 is an improvement over prior art devices. The roller assembly 104 includes an upper idler roller 105 which is mounted on a shaft 106. The shaft 106 is connected to and moved vertically by a pair of cylinders 107. The roller assembly 104 also includes a slotted plate 108 defining a plurality of openings 109. A plurality of elastomeric rollers 110 are mounted on a drive shaft 110 and positioned within the openings 109. The elastomeric rollers 110 extend slightly above the slotted plate 108. Activation of the cylinders 107 move the shaft 106 and the idler roller 104 to a mating position with the upper surfaces of the rollers 110 to insure that the film passes forward to the roll 36 being wrapped. It has been found that the roller assembly 104 is an effective means of moving the film layer from the roll 93 forward without wrapping on itself or otherwise becoming entangled.

The drive shaft 111 is driven by a motor 112 through a connecting gearbox 113. The drive rollers 110 urge the film from the film roll 93 forward over a vacuum table 115 having a perforated upper surface 116.

Figure 14:
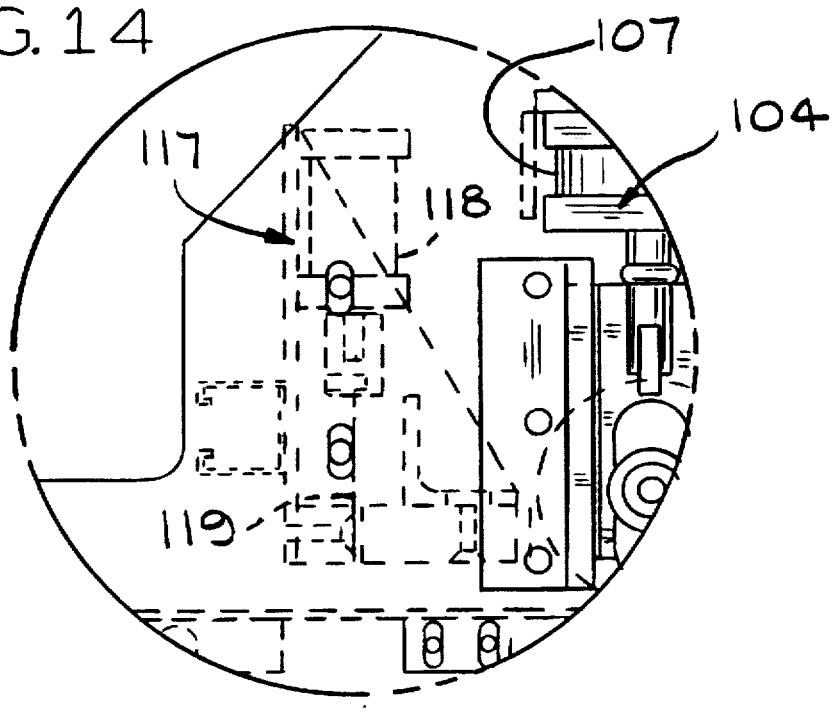
FIG. 14 is a fragmentary elevational view showing by dashed lines a cutter assembly which is a part of the overall carriage assembly.

Referring to FIGS. 11 and 14, a film cutter assembly 117 is mounted adjacent the roller assembly 104. The film cutter assembly 117 includes a reciprocating cylinder 118 which mounts a knife 119. When sufficient film from the roll 93 has been wrapped on the roll 36, the cylinder 118 is actuated and the knife 119 is moved vertically downwardly into cutting position with the film.

Figure 12:
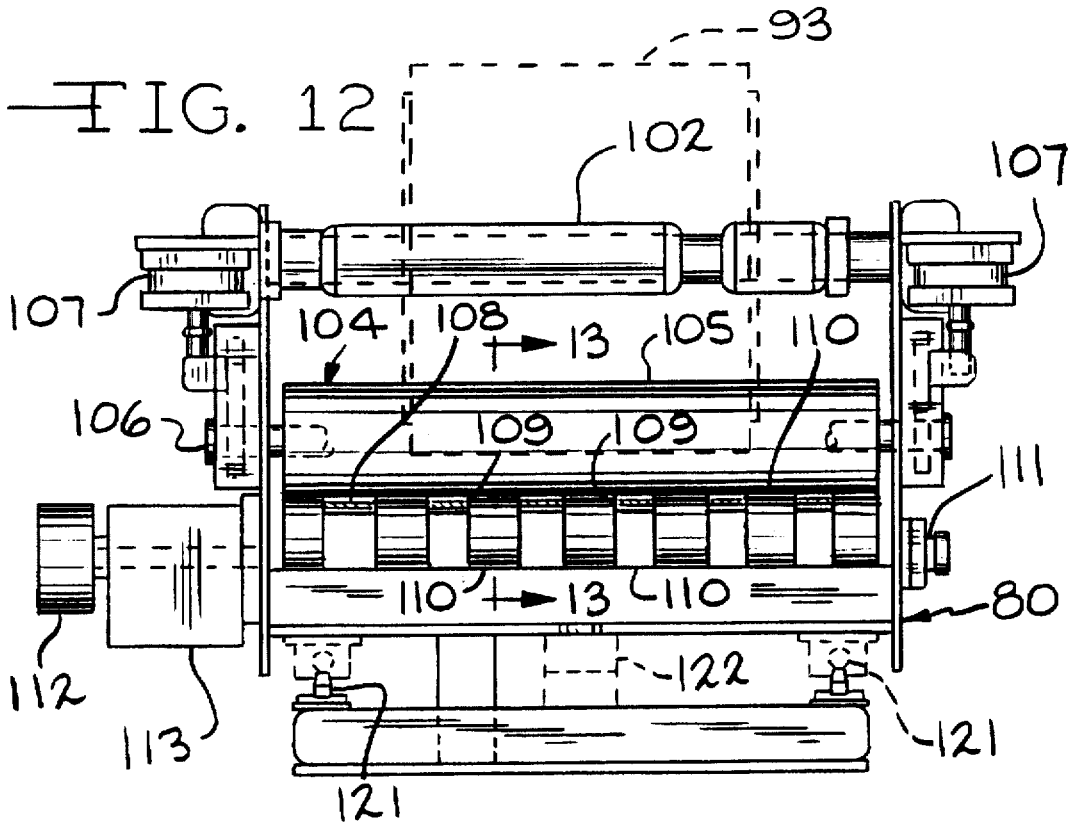
FIG. 12 is a fragmentary end view taken along the line 12—12 of FIG. 11.

Referring to FIGS. 11 and 12, the carriage 89 is movable toward and away from the roll 36 being wrapped. The carriage 89 is mounted on a pair of tracks 121 and is driven by a rodless cylinder 122.

Figure 16:
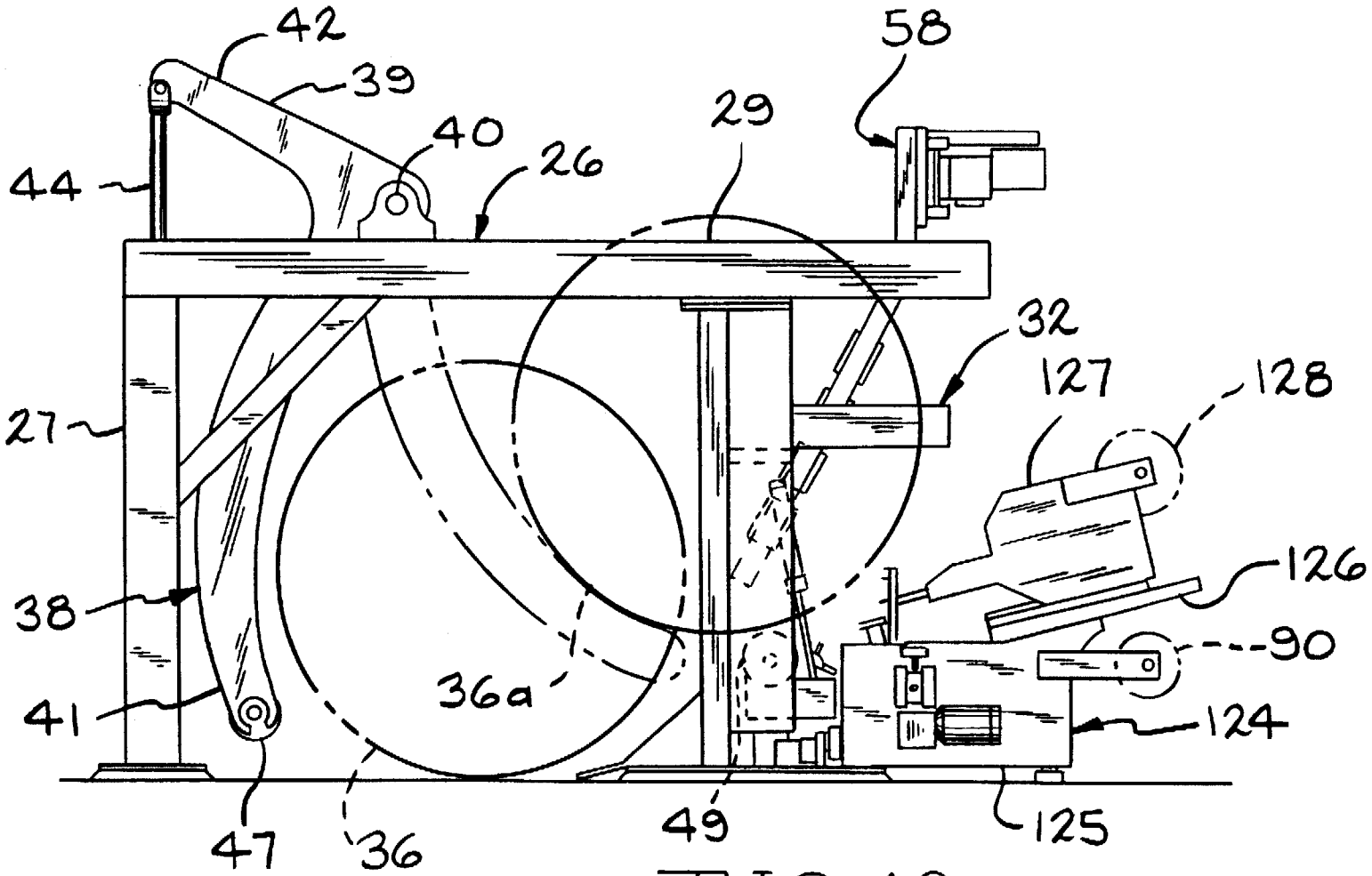
FIG. 16 is an elevational view of another embodiment of a wrapping machine, according to the present invention.
Figure 17:
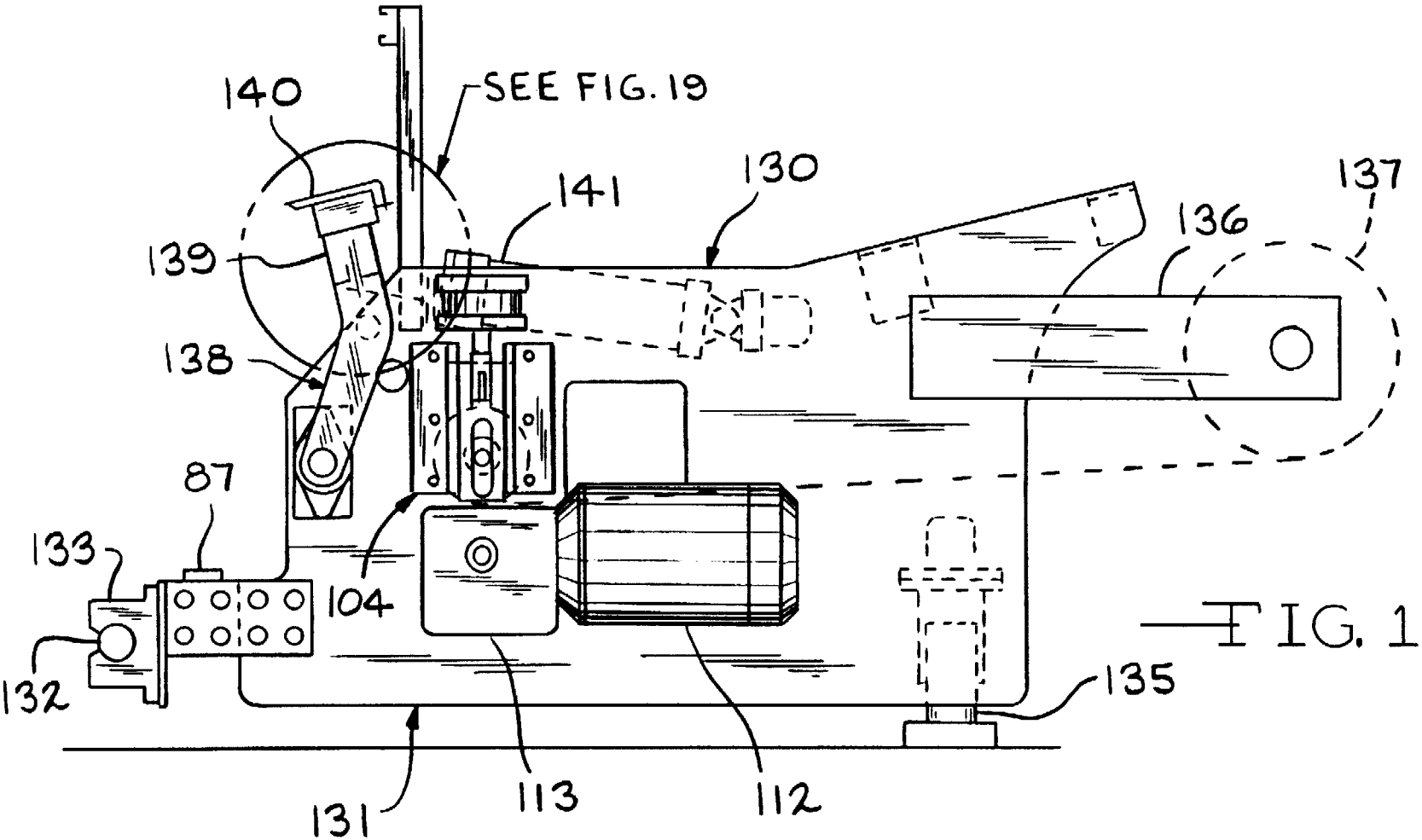
FIG. 17 is an enlarged side elevational view of another embodiment of a carriage assembly according to the present embodiment.

Referring to FIG. 16, another embodiment of a carriage assembly is indicated by a reference number 124. The carriage assembly 124 includes a lower portion 125 similar to the lower portion illustrated in FIG. 11. The lower portion 125 also includes a wrapping material roll 90. In the carriage 124, the lower portion 125 includes a platform 126 which mounts a movable film applicator 127. A wrapping material roll 128 is carried by the film applicator 127. While the wrapping roll 128 may carry various types of wrapping material, the embodiment shown in FIG. 16 is particularly adaptable for a Kraft paper.

Figure 18:
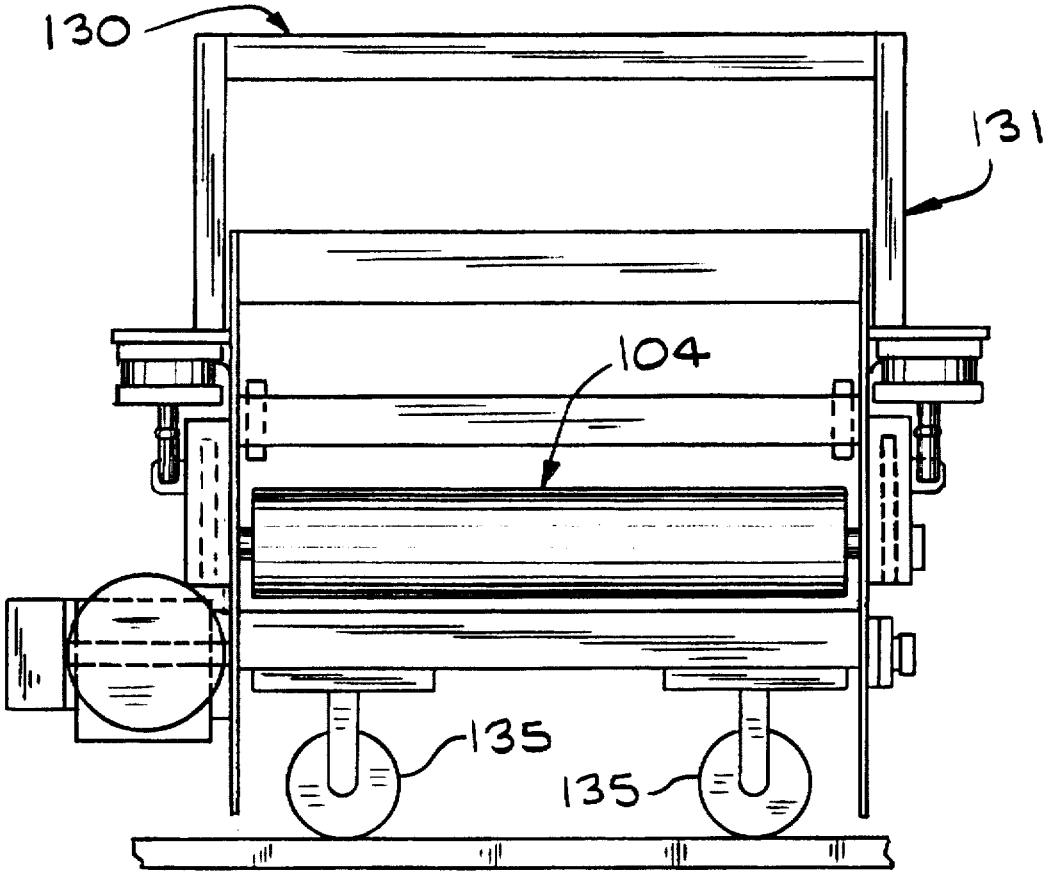
FIG. 18 is an end view of the carriage assembly shown in FIG. 17.
Figure 19:
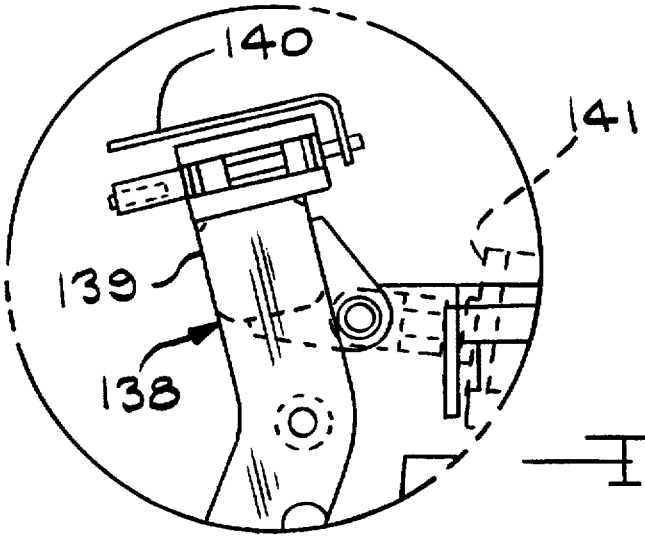
FIG. 19 is an enlarged elevational view of the cutter assembly.
Figure 20:
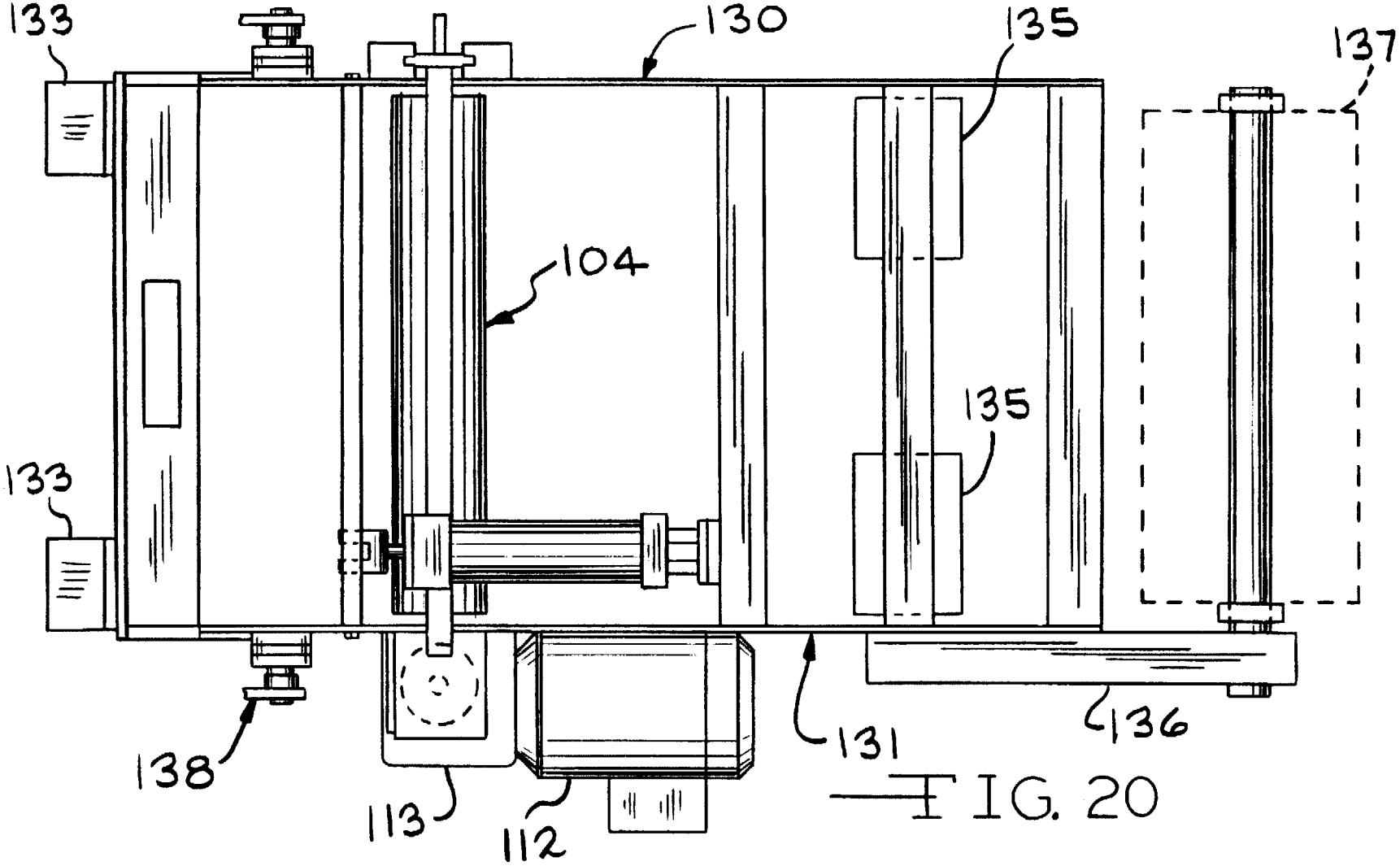
FIG. 20 is a top plan view of the FIG. 17 embodiment.

Still another embodiment of a film applicator for the wrapping machine 25 is indicated by the reference number 130 in FIGS. 17–20. The film applicator 130 is a part of a carriage 131 which is mounted on a horizontal rod 132 which in turn is mounted adjacent the rear vertical legs 28 of the base frame 26. A pair of bearing channels 133 slides on the rod 132. The carriage 131 is connected to the drive chain 87. As best shown in FIG. 18, the carriage 131 mounts a plurality of wheels 135. A support 136 extends from the rear of the film applicator 130 and mount a wrapping material roll 137. While the wrapping material 137 may be of various types, in the present embodiment the preferred material is a plastic film material. The plastic film material 137 extends through the film applicator 130 toward the remainder of the wrapping machine 25. The film material extends through the roller assembly 104.

A film cutter assembly 138 is mounted on the front of the film applicator 130 and includes an arm 139 having a knife 140 mounted on its outer end. A cylinder 141 is operatively connected to the knife arm 139 for rotating the knife 140 into engagement with the film when cutting is desired.

Referring to FIG. 1, in a normal operation, a roll 36 to be covered is moved by a conveyor into the wrapping machine 25 at approximately ground level. The cylinder or cylinders 43 are actuated and the push roller 47 engages the roll 36 to move it upwardly onto the drive roll 49, as indicated by the position **36*a* in FIG. 1. The plate 31 extends between the spaced pivot arms 39 and prevents forward movement of the roll 36. The wrapping machine 25 is a low lift machine. The distance from the ground elevation to the bottom of the roll, when in the position indicated by the reference number 36*a*, is normally 24 inches or less. After the roll is in position, the guide assembly 58 is actuated and the arm 65 having the guide rollers 66 are moved to the desired position adjacent the ends of the roll 36. When in this position, the roll 36 is surrounded on four sides by a cage assembly comprising the arms 39, the plate 31 and the roll frame assembly including the horizontal roll member 34**.

At this time, the carriage assembly 80 is moved into position and, for example, a foam layer from the roll 90 is dispensed to the roll 36 which is being rotated by the drive roller 49. Actuation of the motor 82 of the carriage drive assembly moves the carriage assembly 80 transversely of the wrapping machine 25 to apply the wrapping material from the roll 90 along the length of the roll 36. When the initial wrap is completed, film from the roll 93 is dispensed through the roller assembly 104 to the vacuum table 115 and across the film applicator assembly 95. The assembly 95 is activated to position the film for adherence on the outer periphery of the roll 36, which is being wrapped. Again, the carriage drive assembly 81 is energized to move the carriage assembly 80 along the roll 36 being wrapped. At the end of the application of the second film layer, the film cutter assembly 117 is activated to cut the film.

Many revisions may be made to the above-described preferred embodiments without departing from the scope of the invention or from the following claims.

I claim:

1. A wrapping machine for wrapping a roll having spaced ends which is delivered to such machine approximately at ground elevation, including, a low-lift assembly having pivotable arms with lower ends and a push roller extending between the lower ends of said pivotable arms, a drive assembly including a drive roller spaced from said push roller, said drive assembly including a drive motor operatively connected to said drive roller, a carriage assembly adjacent said drive roller for supporting at least one supply roll of wrap material, said carriage assembly being movable along a path parallel to said drive roller, and a guide assembly including a pair of arms vertically and horizontally movable between an initial rest position and a second position adjacent the ends of such roll, each of said arms mounting a plurality of guide rollers.

2. A wrapping machine, according to claim 1, wherein said low lift assembly elevates the roll approximately twenty-four inches or less from ground elevation after positioning of the roll on said drive roller.

3. A wrapping machine, according to claim 1, wherein said carriage assembly includes a roller assembly adjacent such supply roll, said roller assembly including an idler roller, a slotted plate mounted adjacent said idler roller, said slotted plate defining a plurality of spaced openings, a drive roller mounted in opposed relationship to said idler roller, a plurality of spaced elastomeric rollers mounted on said drive roller, said elastomeric rollers extending through said spaced openings toward said idler roller.

4. A wrapping machine, according to claim 3, including a motor operatively connected to said drive roller.

5. A wrapping machine, according to claim 3, including a cylinder connected to said idler roller for moving said idler roller toward and away from said drive roller.

6. A wrapping machine, according to claim 1, wherein said guide assembly includes a longitudinally extending tube, a cylinder attached to said longitudinally extending tube for rotating said tube, said guide arms extending from said tube and being rotatable with said tube.

7. A wrapping machine, according to claim 6, including a pair of platforms mounted for reciprocal movement along said tube, each of said guide arms being mounted for movement with one of said platforms.

8. A wrapping machine, according to claim 7, including a motor operatively connected to each of said platforms for moving said platform along a path adjacent said tube.

9. A wrapping machine, according to claim 8, including guide track mounted along said path and a plurality of roller assemblies on said platforms, said roller assemblies mounted on said guide track for guiding said platforms and said guide arms along such path.

10. A wrapping machine, according to claim 1, including base frame having front vertical legs, rear vertical legs, top frame members extending between respective ones of said front vertical legs and said rear vertical legs and cross frame members extending between said front vertical legs and said rear vertical legs.

11. A wrapping machine, according to claim 10, including a roll frame assembly mounted between said rear vertical legs, said roll frame assembly including a pair of rearwardly extending arms and a horizontal roll member extending between said rearwardly extending arms.

12. A wrapping machine, according to claim 11, including a plate extending between said pivotable arms of said low lift assembly, said plate, said roll frame assembly and said guide arms of said guide assembly defining a cage assembly.

* * * * *